United States Patent [19]

Kawashima et al.

[11] 4,264,696

[45] Apr. 28, 1981

[54] ELECTROPHOTOGRAPHIC PHOTORECEPTOR

[75] Inventors: Hirokuni Kawashima, Sakurashinmachi; Kiyoshi Suzuki, Yokohama; Yoshiyuki Mimura, Chigasaki; Kunihiko Yoneshima, Hiratsuka, all of Japan

[73] Assignee: Kasei Optonix, Ltd., Tokyo, Japan

[21] Appl. No.: 32,282

[22] Filed: Apr. 23, 1979

[30] Foreign Application Priority Data

Apr. 27, 1978 [JP] Japan ..... 53-50619

[51] Int. Cl.[3] ..... G03G 5/04

[52] U.S. Cl. ..... 430/89; 430/56; 430/84; 430/94

[58] Field of Search ..... 430/84, 89, 94, 96, 430/56; 428/539; 252/501, 518

[56] References Cited

U.S. PATENT DOCUMENTS 3,736,134 5/1973 Gosselink et al. ..... 430/89

*Primary Examiner*—Richard L. Schilling

*Attorney, Agent, or Firm*—Gerald J. Ferguson, Jr; Joseph J. Baker

[57] ABSTRACT

An electrophotographic photoreceptor has a photoconductive layer on a substrate. The photoconductive layer comprises a photoconductor and a water-soluble compound which reacts with free anion released from the photoconductor to produce an unsoluble salt and contains anion having smaller equivalent ionic conductance than that of the free anion.

10 Claims, 1 Drawing Figure

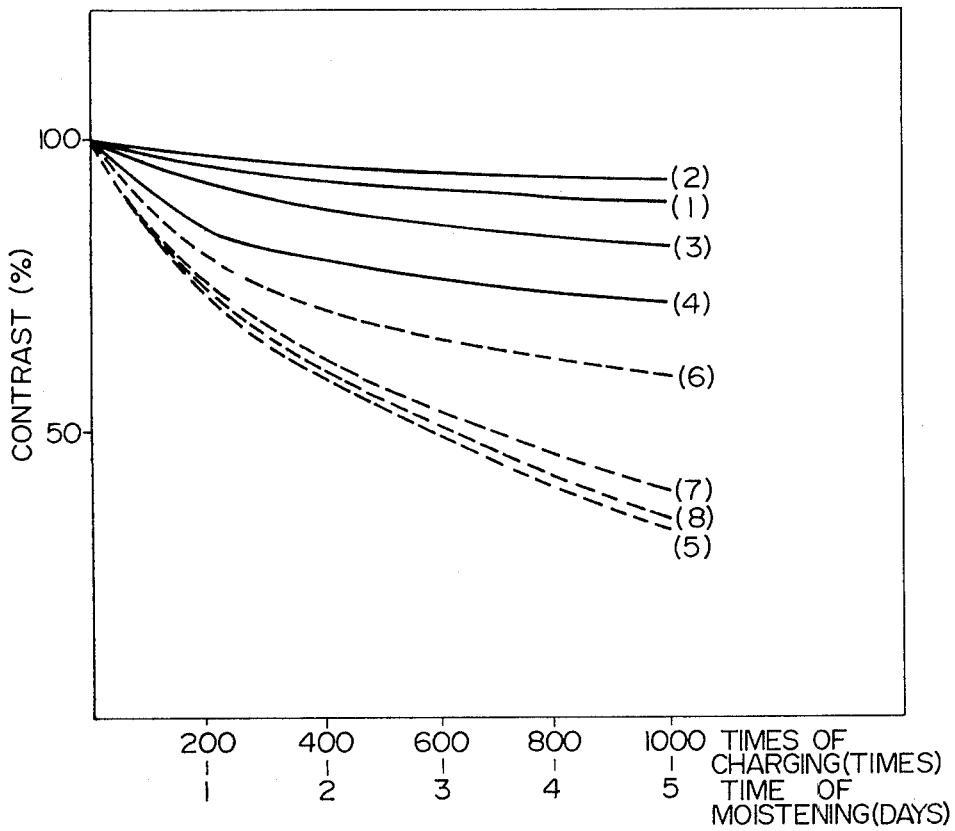
100
50
CONTRAST (%)
(2)
(1)
(3)
(4)
(6)
(7)
(8)
(5)
200
400
600
800
1000
TIMES OF CHARGING(TIMES)
1
2
3
4
5
TIME OF MOISTENING(DAYS)

ELECTROPHOTOGRAPHIC PHOTORECEPTOR

BACKGROUND OF THE INVENTION

1. Field of the Invention

The present invention relates to an electrophotographic photoreceptor, and more particularly to an electrophotographic photoreceptor in which lowering of electric resistance thereof is prevented.

2. Description of the Prior Art

There have been known a number of types of electrophotographic photoreceptors of different structure and a number of electrophotographic processes have been known in the art. As typical electrophotographic photoreceptors, a photoreceptor comprising a substrate and a photoconductive layer formed thereon, and a photoreceptor comprising a substrate, a photoconductive layer and an insulating layer laminated in this order have been known and employed widely in image formation. The photoreceptor comprising a substrate and a photoconductive layer is employed in the most typical electrophotographic process comprising charging, exposure to imagewise light and development, and further transfer of the developed image when required. In the photoreceptor having an insulating layer, the insulating layer is provided for the purpose of protecting the photoconductive layer, improving the mechanical strength of the photoreceptor and conforming the photoreceptor to a specific electrophotographic process. Representative examples of the photoreceptors having an insulating layer and the processes conducted therewith are described in, for example, U.S. Pat. No. 2,860,048 and Japanese Patent Publication Nos. 16,429/1966, 15,446/1963, 3,713/1971, 23,910/1967, 24,748/1968, 19,747/1967 and 4,121/1961.

An electrophotographic photoreceptor is required not only to have characteristics necessary for the electrophotographic process such as photosensitivity and electric and optical characteristics, but also to exhibit stability of the characteristics when used under various conditions. Nevertheless, an electrophotographic photoreceptor employing a photoconductor which releases free ions is deteriorated by moisture. That is, in such an electrophotographic photoreceptor, it is not possible to obtain a high electric potential in the unexposed area of the electrostatic latent image and a high contrast potential thereof when the electrostatic latent image is formed in the atmosphere of high humidity.

Since such a photoconductor is generally dispersed in a binder to form a photoconductive layer, various improvements in the binder have heretofore been attempted to prevent the deterioration by moisture. For example, Japanese Patent Publication No. 33,861/1975 discloses the use of watersoluble copolymer of itaconic acid monoalkyl ester, itaconic acid dialkyl ester and specific vinyl monomer as a binder of photoconductive zinc oxide to obtain an electrophotographic recording sheet exhibiting less deterioration when used in an atmosphere of high humidity. Also, Japanese Patent Application Laid Open No. 93,149/1975 discloses the formation of moistureproof layer comprising a deionization-treated material such as polyvinyl alcohol, gelatin and gum arabic over the surface of a photoconductive layer provided on a substrate to obtain an electrophotographic photoreceptor having improved resistance to moisture. Further, Japanese Patent Publication No. 13,582/1976 discloses the use of insulating resinous binder containing a composition comprising alkylated silica and a blending resin such as phenolic resin, polyamide resin and polyester resin to obtain an electrophotographic photoreceptor having improved resistance to moisture. However, although the above-mentioned publications disclose the prevention of deterioration by moisture of the electrophotographic photoreceptor by improving the resistance to moisture thereof, they do not deal with or suggest the prevention of deterioration by moisture of the photoconductor itself. Further, when the resistance to moisture of the photoreceptor is elevated by improving the binder employed in the photoconductive layer thereof as described above, unevenness is generally apt to arise in the resulting image.

Japanese Patent Publication No. 33,740/1976 discloses an electrophotographic photoreceptor using a photoconductor which is deionization-treated by means of ion exchange resin to prevent the deterioration by moisture. However, the deionization treatment disclosed in this publication is conducted to remove residual ions contained in the photoconductor before the photoconductor is incorporated into the photoreceptor. Therefore, this publication does not show the removal of free ions which are generated in the photoreceptor when the photoreceptor is used repeatedly.

SUMMARY OF THE INVENTION

An object of the present invention is to provide an electrophotographic photoreceptor in which the deterioration by moisture thereof is improved.

That is, an object of the present invention is to provide an electrophotographic photoreceptor wherein the lowering of the potential in the unexposed area of the electrostatic latent image and the contrast potential thereof caused when the photoreceptor is repeatedly used in the atmosphere of high humidity is prevented.

The inventors of the present invention conducted various investigations on electrophotographic photoreceptor to accomplish the above-mentioned object. As the result of the investigations, it was found that the deterioration by moisture of the photoreceptor could be prevented by adding a specific compound to the photoconductive layer of the photoreceptor.

The electrophotographic photoreceptor of the present invention has a photoconductive layer comprising a photoconductor and a water-soluble compound which reacts with free anion released from the photoconductor to produce an insoluble salt and contains anion having smaller equivalent ionic conductance than that of the free anion released from the photoconductor.

The compound employed in the photoreceptor of the present invention removes not only free anion originally contained in the photoconductor (residual anion) but also free anion generated during repeated use of the photoreceptor, whereby the deterioration by moisture of the photoreceptor is markedly improved. Further, in the photoreceptor of the present invention, the resulting image is free from unevenness which is apt to arise when the resistance to moisture of the photoreceptor is elevated by improving the binder employed in the photoconductive layer thereof.

BRIEF DESCRIPTION OF THE DRAWING

The attached FIGURE is a graph showing deterioration by moisture of several electrophotograhic photoreceptors wherein curves (1), (2), (3), (4), (6), (7) and (8) represent deterioration by moisture of electrophotographic photoreceptors having a photoconductive layer containing barium acetate, lead acetate, barium aluminate, strontium acetate, barium diphenyl amine sulfonate, lead borate and barium carbonate, respectively, and curve (5) represents deterioration by moisture of electrophotographic photoreceptor having a photoconductive layer to which a specific compound is not added.

DESCRIPTION OF THE PREFERRED EMBODIMENTS

The deterioration by moisture of the photoreceptor, that is, the lowering of the electric resistance of the photoconductive layer thereof is caused by free ion generated by the decomposition of the photoconductor when the photoreceptor with absorbed moisture is subjected to corona charging of high voltage. In the photoreceptor of the present invention, the water-soluble compound contained in the photoconductive layer reacts under the presence of moisture with the free anion released from the photoconductor to precipitate an insoluble salt, and simultaneously, releases anion formed by the water-soluble compound that has smaller equivalent ionic conductance than that of the free anion released from the photoconductor, whereby lowering of the electric resistance of the photoconductive layer is reduced.

As the photoconductors to be employed in the photoreceptor of the present invention, chalcogenide photoconductors such as cadmium sulfide (CdS), cadmium sulfoselenide [Cd(S,Se)], zinc sulfide (ZnS), zinc sulfoselenide [Zn(S,Se)], lead sulfide (PbS), zinc oxide (ZnO), zinc selenide (ZnSe), zinc telluride (ZnTe), cadmium selenide (CdSe) and cadmium telluride (CdTe) are used. In particular, remarkably good results can be obtained with the photoreceptors in which a sulfide photoconductor such as CdS, Cd(S,Se), ZnS, Zn(S,Se) and PbS is employed.

The water-soluble compound employed in the photoreceptor of the present invention may be any water-soluble compound provided the compound reacts with the free anion released from the photoconductor to produce an insoluble salt and contains anion having smaller equivalent ionic conductance than that of the free anion released from the photoconductor. The solubility in water of the water-soluble compound is preferably not less than 1 weight%, more preferably not less than 10 weight%. When the solubility in water of the water-soluble compound is very small, a large amount of compound is needed to provide sufficient amount of cation to react with the free anion released from the photoconductor to produce an unsoluble salt, and in such a case, the compound is apt to adversely affect the photoconductivity of the photoreceptor, viz., the resulting image. As a matter of course, the equivalent ionic conductance of the anion contained in the water-soluble compound is preferred to be as small as possible. In general, the equivalent ionic conductance thereof is preferably not more than 0.7 times, more preferably not more than 0.55 times as large as that of the anion released from the photoconductor.

The present invention will hereinbelow be described in detail referring to the particular embodiment employing sulfide photoconductor.

As the result of the investigation on the constituents of the photoreceptor such as photoconductor and binder, it was found that the electric resistance of these constituents was lowered by the moisture absorbed therein when corona charging was repeated. In particular, it was found that a very small quantity of the photoconductor was decomposed by the moisture absorbed therein when corona charging was repeated. For example, in the case of CdS photoconductor, $Cd^{2+}$ and $SO_4^{2-}$ are generated as the result of decomposition. It is believed that CdS is decomposed into $Cd^{2+}$ and $SO_4^{2-}$ by the moisture absorbed therein and $O_3$ or Joule's heat generated by corona charging of high voltage. Accordingly, even though free ions such as $Cd^{2+}$ and $SO_4^{2-}$ originally contained in CdS photoconductor, and free ions such as $Cu^{+}$, $Cu^{2+}$ and $Cl^{-}$ further contained therein as activators are removed by washing with water or deionization-treatment with ion exchange resins before the CdS photoconductor is dispersed in a resinous binder and applied to a substrate to prepare a photoreceptor, the above-mentioned decomposition of CdS takes place when the photoreceptor prepared is used repeatedly in the atmosphere of high humidity. Therefore, the electric resistance of the photoreceptor is lowered after repeated use thereof.

In practical use of the photoreceptor, the atmosphere of high humidity does not usually last for a long period of time, viz., for many days. Further, the lowering of the electric resistance of the photoreceptor can be prevented by either raising the temperature of the atmosphere in which the photoreceptor is used or drying the photoreceptor forcedly to evaporate the moisture absorbed therein and cause dissociated $Cd^{2+}$ and $SO_4^{2-}$ as $CdSO_4$ to be deposited. However, in so far as $CdSO_4$ is contained in the photoreceptor, the deterioration by moisture of the photoreceptor cannot be basically prevented. That is, when the photoreceptor containing $CdSO_4$ absorbs moisture, $CdSO_4$ is dissociated into $Cd^{2+}$ and $SO_4^{2-}$, whereby the electric resistance of the photoreceptor is lowered immediately. Further, it is undesirable to provide a drying device in an electrophotographic apparatus from the viewpoint of the size and the manufacturing cost thereof.

In the present invention, a water-soluble compound as of barium, lead and strontium which reacts with $SO_4^{2-}$ released from sulfide photoconductor to produce an insoluble salt and contains anion having smaller equivalent ionic conductance than that of $SO_4^{2-}$ (79 $ohm^{-1}$ $cm^2$/equivalent, 25° C.) is added to the sulfide photoconductor to precipitate as an insoluble salt $SO_4^{2-}$ released therefrom when the photoreceptor absorbs moisture, whereby $SO_4^{2-}$ is prevented from conducting through the medium of moisture, and accordingly, the electric resistance of the photoreceptor is not lowered. The present invention can be widely applied to various photoconductors including above-mentioned sulfide photoconductor which release anions under the presence of moisture.

As the representative water-soluble compounds which can be added to the sulfide photoconductor in this invention, carboxylates of barium, lead and strontium such as acetate, propionate and formate and barium aluminate are used. Above all, lead acetate, barium acetate, barium aluminate and strontium acetate are preferable.

The amount of the water-soluble compound added to the sulfide photoconductor is decided according to circumstances. Generally, the compound is added to the sulfide photoconductor in such an amount that the amount of the metallic ion contained in the compound is within the range of $10^{-6}$ to $10^{-5}$ gram ions, more preferably $2\times10^{-6}$ to $7\times10^{-6}$ gram ions per one gram of the sulfide photoconductor.

The photoconductive layer of the photoreceptor of the present invention is generally composed of a binder, and a photoconductor dispersed therein containing water-soluble compound. Various resins, for example, vinyl chloride resin, vinyl acetate resin, vinyl chloride-vinyl acetate copolymer resin, acrylic resin, urethan resin, polyester resin, epoxy resin, melamine resin, silicone resin, etc. can be employed as the binder. The amount of the resinous binder is preferably within the range of 0.5 to 50 parts by weight, more preferably 5 to 20 parts by weight per 100 parts by weight of the photoconductor containing water-soluble compound. The photoconductive layer may be only composed of the photoconductor containing water-soluble compound. Such a photoconductive layer can be formed by electrodeposition or the like.

In the photoreceptor having an insulating layer of the present invention, various conventional resins can be used as the insulating layer. For example, polyethylene, polyester, polypropylene, polystyrene, polyvinyl chloride, polyvinyl acetate, acrylic resin, polycarbonate, silicone resin, fluorine resin, epoxy resin, and the like can be used. Generally, the thickness of the insulating layer is preferably within the range of 0.1 to 100$\mu$, more preferably 0.1 to 50$\mu$.

The substrate of the photoreceptor of the present invention can be made of metal plate such as stainless steel, copper, aluminum and tin, paper, resin film, and the like. The substrate can be omitted when desired.

The thickness of the photoconductive layer is properly decided according to the kind of the photoconductor, the characteristics thereof, etc. In general, the thickness of the photoconductive layer is preferably within the range of 5 to 100$\mu$, more preferably 10 to 50$\mu$.

In accordance with the present invention, the water-soluble compound contained in the photoconductive layer of the photoreceptor removes not only the free anion originally contained in the photoconductor but also the free anion generated therein when the photoreceptor is used repeatedly in the atmosphere of high humidity, whereby the deterioration by moisture of the photoreceptor is markedly improved. Further, in the photoreceptor of the present invention, the resulting image is free from unevenness which is apt to arise when the resistance to moisture of the photoreceptor is elevated by improving the binder.

Now the present invention will be described with reference to several examples thereof and several comparative examples.

EXAMPLE 1

CdS powder was put into a desiccator containing humidity of 100% RH to moisten the powder and was subjected to a severe deteriorating condition of 2000 times of repeated corona charging and 16 days of moistening time. Then, the CdS powder was subjected to elution test and the amount of $SO_4$ dissociated from the CdS powder was measured. The elution test was conducted by putting 20 g of the CdS powder into 100 ml of pure water, stirring the mixture with a stirrer for ten minutes, filtering the mixture and separating the supernatant liquid, and measuring $SO_4^{2-}$ in the supernatant liquid. As a result of this test, it was found that $SO_4^{2-}$ ion in the amount of about $1.56\times10^{-6}$ ion/lgCdS was dissociated. Therefore, it was found that it was necessary to add a compound to the CdS powder for producing an isoluble salt of the amount equivalent to the amount of $SO_4^{2-}$ dissociated from the CdS powder before it was applied to a substrate to form an electrophotographic photoreceptor plus $1.56\times10^{-6}$ ion/lgCdS.

Then, in order to determine the optimum amount of the compound to be added, a test was conducted with barium acetate. The amount of barium acetate was changed in the amount of barium ion as 0, $1.83\times10^{-6}$, $2.38\times10^{-6}$, $3.63\times10^{-6}$, $5.49\times10^{-6}$, $6.40\times10^{-6}$, $7.32\times10^{-6}$ gram ion per lg of CdS, and the result was evaluated. The evaluation was made in terms of deterioration with repeated charging and moistening time where the initial contrast potential (Vco) of the electrophotographic photoreceptor was first measured, the photoreceptor was then moistened in a desiccator of 100% RH and subjected to repeated corona charging for five days at the rate of 200 times a day, and then the contrast potential (Vc) was measured again, and the ratio of the two potentials Vc/Vco was used for evaluation in the unit of %. The results thus obtained are shown in Table 1 below.

TABLE 1

| Added amount gram ion/lgCdS | Vco(v) | Vc(v) | Evaluation of Deterioration (%) |
|---|---|---|---|
| $0\times10^{-6}$ | 700 | 224 | 32 |
| $1.83\times10^{-6}$ | 704 | 394 | 56 |
| $2.38\times10^{-6}$ | 705 | 508 | 72 |
| $3.63\times10^{-6}$ | 720 | 634 | 88 |
| $5.49\times10^{-6}$ | 700 | 518 | 74 |
| $6.40\times10^{-6}$ | 680 | 500 | 74 |
| $7.32\times10^{-6}$ | 400 | 268 | 67 |

As shown in Table 1, the range of 2.38 to $6.40\times10^{-6}$ gram ion/lgCdS is the optimum range. The lower limit of this range is larger than said $1.56\times10^{-6}$ gram ion/lgCdS, which is considered to be based on the $SO_4^{2-}$ ion component originally contained in the CdS powder and the probability of ion contact of $SO_4^{2-}$ ion and $Ba^{2+}$ ion. When the added amount of the compound is less than the lower limit, the contrast is too much lowered. When the added amount of the compound is more than the upper limit, the resistance of the photoconductor is lowered and the image density is insufficient from the beginning.

The compound was added to the CdS by first solving the compound in pure water and the solution was put into the CdS powder and stirred. Then, the CdS slurry containing $Ba^{2+}$ ion was dried to obtain a photoconductor. The compound was first solved in water for the purpose of well dispersing the compound in CdS.

The photoconductor powder thus obtained was mixed with acrylic resin, alkid resin, vinyl resin, silicone resin, polyester resin, urethane resin or the like, and was dispersed therein with a roll mill, and applied on a substrate with a knife coater, roll coater, flow coater or the like, and dried to obtain an electrophotographic photoreceptor in accordance with the present invention. Further, on the photoconductor may be applied, when required, an insulating layer.

The electrophotographic photoreceptor thus obtained had high quality of image sharpness, uniformity of density of the image in the unexposed areas, and life for repeated use. Further, particularly the photoreceptor had excellent resistance to moisture. In this example, a compound which had low water solubility or contained anion having the equivalent ionic conductance which was the same as or higher than that of $SO_4^{2-}$ released from the photoconductor such as $BaBr_2$, $BaCO_3$, $BaCl_2$, $Pb(BO_2)_2H_2O$, $Pb(CO_3)_2.Pb(OH)_2$, $Sr(NO_3)_2$, $SrF_2$, $SrSO_4.H_2O$ was not effective to improve the photoreceptor.

EXAMPLE 2

Into 100 g of CDS photoconductor activated with Cu in which the amount of dissociated $SO_4^{2-}$ is $2.08\times10^{-6}$ gram ion/lgCdS was put a water solution of 0.099 g of barium acetate $[Ba(CH_3COO)_2.\ H_2O]$ (equivalent to $3.65\times10^{-6}$ gram ion/lgCdS of $SO_4^{2-}$) and stirred with a stirrer having the number of revolutions of 120 rpm for 30 minutes, and then dried to obtain a photoconductor. The photoconductor thus obtained was applied on a substrate in the thickness of about 40μ by use of polyvinyl resin, and an insulating layer of polyester film having a thickness of 25μ was provided thereon to form a photoreceptor. The photoreceptor thus obtained was subjected to an electrophotographic process consisting of a first DC charging, a second AC charging and simultaneous imagewise exposure, and total exposure. As shown in Table 2 and in the drawing by curve (1), the contrast potential and the resistance to moisture were improved. The image quality was also good as a result of the image quality test.

TABLE 2

| Water-soluble Compound | Initial contrast (v) |
|---|---|
| (1) barium acetate | 720 |
| (2) lead acetate | 680 |
| (3) barium aluminate | 650 |
| (4) strontium acetate | 640 |
| (5) none | 700 |
| (6) barium diphenylamine sulfonate | 500 |
| (7) lead borate | 560 |
| (8) barium carbonate | 660 |

EXAMPLE 3

0.137 g of lead acetate $[Pb(CH_3COO)_2.3H_2O]$ was added to 100 g of the same CdS photoconductor as that used in Example 1 in the same manner and under the same condition as in Example 1. The result was good as shown in Table 2 at (2) and in the drawing by curve (2).

EXAMPLE 4

0.0920 g of barium aluminate $(BaAl_2O_4)$ was added to 100 g of the same CdS photoconductor as that used in Example 2 in the same manner as in Example 2. The result was good as shown in Table 2 at (3) and in the drawing by curve (3).

EXAMPLE 5

0.0752 g of strontium acetate $[Sr(CH_3COO)_2.\frac{1}{2}H_2O]$ was added to 100 g of the same CdS photoconductor as that used in Example 2 in the same manner as in Example 2. The result was good as shown in Table 2 at (4) and in the drawing by curve (4).

EXAMPLE 6

0.150g of lead acetate $[(CH_3COO)_2Pb.3H_2O]$ was added to 100 g of the same CdS photoconductor as that used in Example 1 in the same manner as in Example 1.

The photoconductor thus obtained was made into an electrophotographic photoreceptor by use of a binder consisting of multivalent isocyanate compound and polyol resin. The photoreceptor was subjected to an electrophotographic process consisting of a negative corona charging and imagewise light exposure. As a result, an image of high quality with the contrast potential of 450 V was obtained. After the five days of moistening and 1000 times of charging, the evaluation of deterioration was 75%, which was markedly higher than 30% of the photoreceptor with the conventional untreated CdS.

COMPARATIVE EXAMPLE 1

100 g of the same CdS photoconductor as that used in Example 2 was put into pure water and treated in the same manner as in Example 2 without adding any additive. As a result, though the initial potential was good as shown in Table 2 at (5), the deterioration down to 33% was observed after five days of moistening and 600 times of charging as shown in the drawing by curve (5).

COMPARATIVE EXAMPLE 2

0.231 g of barium diphenylamine sulfonate $[(C_6H_5NHC_6H_4SO_3)_2Ba]$ was added to 100 g of the same CdS photoconductor as that used in Example 2 in the same manner as in Example 2. As a result, though the resistance to moisture was good, the initial contrast was insufficient as shown in Table 2 at (6) and in the drawing by curve (6). COMPARATIVE EXAMPLE 3

A suspension in pure water of 0.0938 g of lead borate $[Pb(BO_2)_2H_2O]$ was added to 100 g of the same CdS photoconductor as that used in Example 2 and a photoreceptor was obtained like Example 2. As a result, the initial contrast was low and the resistance to moisture was also low as shown in Table 2 at (7) and in the drawing by curve (7).

COMPARATIVE EXAMPLE 4

A suspension in pure water of 0.0691 g of barium carbonate $(BaCO_3)$ was added to 100 g of the same CdS photoconductor as that used in Example 2 in the same manner as in Example 1. As a result, though the initial contrast was good as shown in Table 2 at (8), the resistance to moisture was low as shown in the drawing by curve (8). Further, the obtained image was very poor in quality with prominent unevenness in density.

COMPARATIVE EXAMPLE 5

A photoreceptor prepared in accordance with the conventional method by use of styrene resin having a smaller number of hydrophilic functional groups showed good resistance to moisture but the unevenness in density was very large in unexposed areas.

I claim:

1. An electrophotographic photoreceptor having a photoconductive layer comprising a sulfide photoconductor and a water-soluble compound which reacts with a free $SO_4^{-2}$ anion released from said sulfide photoconductor to produce an unsoluble salt and contains an anion having smaller equivalent ionic conductance than that of said free anion.

2. An electrophotographic photoreceptor as defined in claim 1 wherein said sulfide photoconductor is at least one member selected from the group consisting of cadmium sulfide, cadmium sulfoselenide, zinc sulfide, zinc sulfoselenide and lead sulfide.

3. An electrophotographic photoreceptor as defined in claim 1 wherein said water-soluble compound is at least one member selected from the group consisting of barium aluminate and carboxylates of barium, lead and strontium.

4. An electrophotographic photoreceptor as defined in claim 1 wherein said water-soluble compound contains a metallic ion, the amount of said water-soluble compound being such that the amount of the metallic ion contained in said water-soluble compound is within the range of $10^{-6}$ to $10^{-5}$ gram ions per one gram of said sulfide photoconductor.

5. An electrophotographic photoreceptor as defined in claim 1 wherein said equivalent ionic conductance of said anion contained in said water-soluble compound is not less than 0.7 times as large as that of said free anion.

6. An electrophotographic photoreceptor as defined in claim 5 wherein said equivalent ionic conductance of said anion contained in said water-soluble compound is not less than 0.55 times as large as that of said free anion.

7. An electrophotographic photoreceptor having a photoconductive layer comprising a sulfide photoconductor and a water-soluble compound which is at least one member selected from the group consisting of barium aluminate and carboxylates of barium, lead and strontium.

8. An electrophotographic photoreceptor as defined in claim 7 wherein the amount of said water-soluble compound is such that the amount of the metallic ion contained in the water-soluble compound is within the range of $10^{-6}$ to $10^{-5}$ grams ions per one gram of said sulfide photoconductor.

9. An electrophotographic photoreceptor as defined in claims 3 or 7 wherein said water-soluble compound is at least one member selected from the group consisting of lead acetate, barium acetate, barium aluminate and strontium acetate.

10. An electrophotographic photoreceptor as defined in claims 4 or 8 wherein said range is $2\times10^{-6}$ to $7\times10^{-6}$ gram ions.

* * * * *